United States Patent [19]

Hillinger

[11] Patent Number: 4,998,616

[45] Date of Patent: Mar. 12, 1991

[54] FOUR PLY FOLD-UP DISPLAY AND CARRYING CASE

[75] Inventor: George Hillinger, Los Angeles, Calif.

[73] Assignee: Alltrade, Inc., Commerce, Calif.

[21] Appl. No.: 375,599

[22] Filed: Jul. 5, 1989

[51] Int. Cl.[5] ..... B65D 6/04

[52] U.S. Cl. ..... 206/45.11; 190/17; 206/372; 220/520

[58] Field of Search ..... 190/16, 17, 117; 220/6, 220/7, 20, 22, 520; 206/44.11, 45.11, 372

[56] References Cited

U.S. PATENT DOCUMENTS

| | | | |
|---|---|---|---|
| 294,938 | 3/1884 | Traver | 206/45.11 |
| 695,326 | 3/1902 | Morris | 190/16 |
| 803,732 | 11/1905 | Turner | 190/17 |
| 818,712 | 4/1906 | Shaw | 190/16 |
| 2,718,447 | 9/1955 | Wright | 220/6 |
| 3,155,231 | 11/1964 | Vinas | 220/20 |
| 3,305,076 | 2/1967 | Fleenor | 220/22 |
| 3,334,714 | 8/1967 | Gordon | 190/117 |
| 3,717,228 | 2/1973 | Blair | 190/117 |
| 4,336,883 | 6/1982 | Krug et al. | 190/117 |
| 4,773,536 | 9/1988 | Rau | 190/117 |

FOREIGN PATENT DOCUMENTS

| | | | |
|---|---|---|---|
| 3717226 | 2/1988 | Fed. Rep. of Germany | 190/16 |
| 0373219 | 5/1973 | U.S.S.R. | 190/16 |

*Primary Examiner*—Jimmy G. Foster

*Attorney, Agent, or Firm*—Edgar W. Averill, Jr.

[57] ABSTRACT

A four ply fold-up display and carrying case. The case has four plies which are hinged together. The outer plies are hinged at the bottom, and the inner plies are hinged both at the bottom and the top so that the case opens up in an accordion-like manner so that all four plies have an upwardly facing compartment.

7 Claims, 3 Drawing Sheets

FIG. 11.
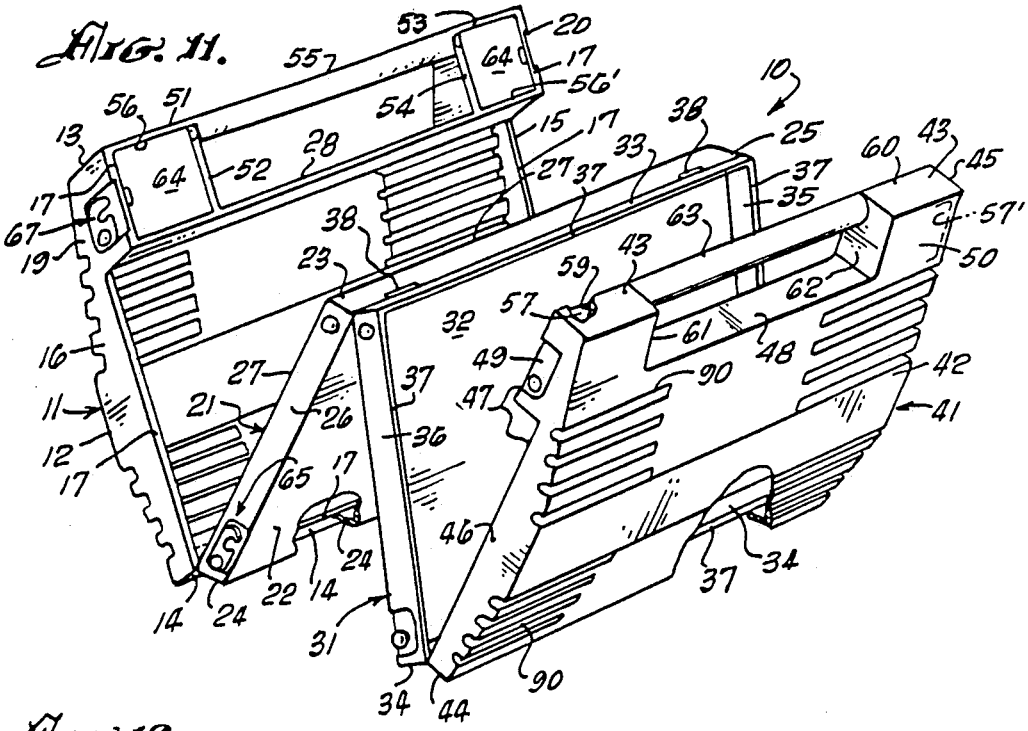
FIG. 12.
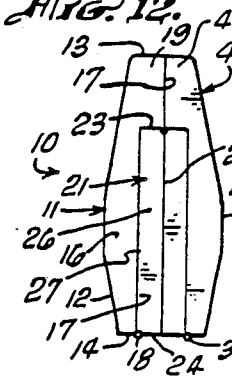
FIG. 13.
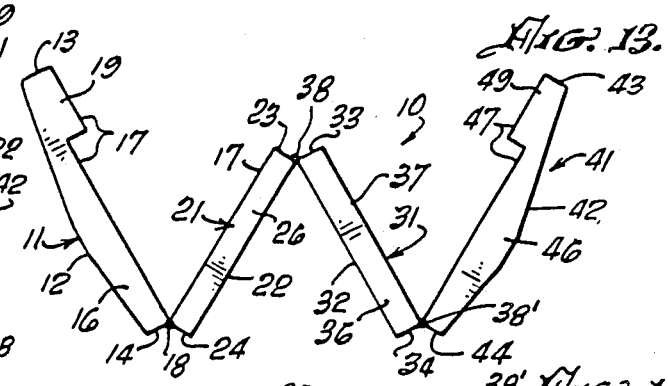
FIG. 15.
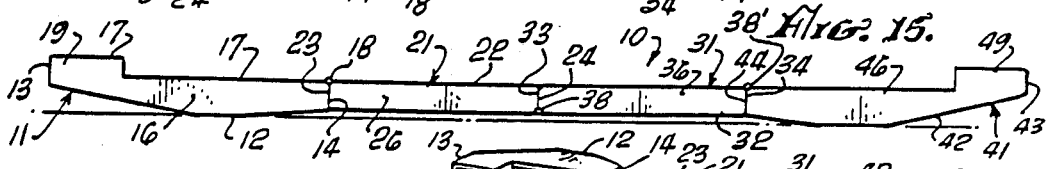
FIG. 14.
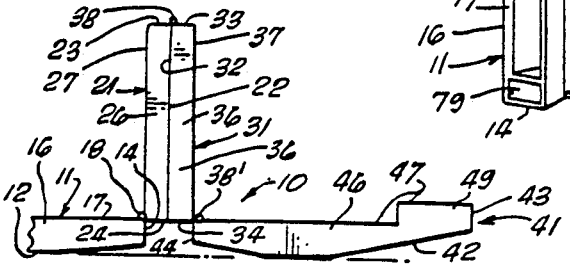
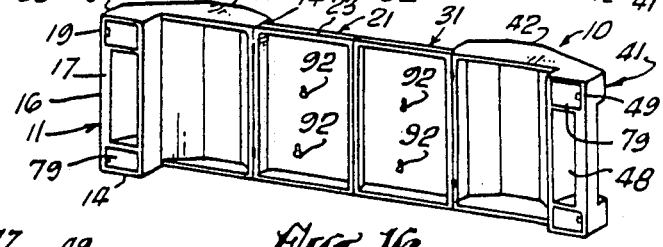
FIG. 16.

FOUR PLY FOLD-UP DISPLAY AND CARRYING CASE

BACKGROUND OF THE INVENTION

The field of the invention is carrying cases, and the invention relates more particularly to carrying cases of the type useful for displaying the contents of the case.

For many applications such as tool boxes or display cases, it is important that the various objects placed within the case be easily seen. This is, of course, true for the workman who needs to select a particular tool from a collection of tools and does not wish to have to pore through a container of tools to find the right one. This is also very useful for salesmen who are displaying objects for sale where the visibility of the objects is very important. The same case, whether it be a tool case, display case or the like, also must be easily folded up for transporting contents and is, preferably, also latchable in a closed configuration.

SUMMARY OF THE INVENTION

It is an object of the present invention to provide a container which may be folded up to provide an easily transported unit or may be opened into four visible plies.

The present invention is for a four ply fold-up display and carrying case. The case has a first ply comprising a generally rectangular open compartment having an open side, an outer side, a bottom, two edge sides and a top side. Each of the bottom, edge and top sides have an edge at the open side and hinges are positioned along the edge of the bottom. A second ply is hingedly affixed to the hinge means of the first ply and has a generally rectangular open compartment having an open side, an inner side, a bottom, two edge sides and a top side, and each of the bottom, edge and top sides also has an edge at the open side. The second ply has bottom hinge means which are hingedly attached to the hinge means of the first ply, and the second ply also has a top hinge means along the inner section of the inner side and the top side. A third ply is hingedly connected to the second ply at the top hinge means of the second ply and has an open compartment having an open side, an inner side, a bottom, two edge sides and a top side, each of the bottom edge and top sides having an edge at the open side. The third ply has top hinge means which are connected to the top hinge means of the second ply and also has bottom hinge means along the edge of the bottom. A fourth ply is hingedly connected to the third ply and has an open compartment having an open side, an outer side, a bottom, two edge sides and a top side, and each of the bottom, edge and top sides has an edge at the open side. The fourth ply has hinge means along the edge of the bottom which is hingedly attached to the bottom hinge means of the third ply. A first pair of latch means latches the inner side of the second and third plies together, a second pair of latch means latches the first and fourth plies together over the second and third plies whereby the case may be either opened to fully display the contents of the four plies or may be folded into a completely closed configuration. Preferably, the edge sides of the first and fourth plies are extended upwardly, and a handle is affixed therebetween.

BRIEF DESCRIPTION OF THE DRAWINGS

FIG. 11 is a perspective view showing the case of FIG. 1 in a partially opened configuration.

FIG. 12 is an end view thereof.

FIG. 13 is a side view of the case in its configuration of FIG. 11.

FIG. 14 is a side view showing the two outer plies opened with the two inner plies closed.

FIG. 15 is a side view of the case of FIG. 1 in a completely opened configuration.

FIG. 16 is a side view of the case of FIG. 15 being placed on its side.

DESCRIPTION OF THE PREFERRED EMBODIMENTS

Figure 1:
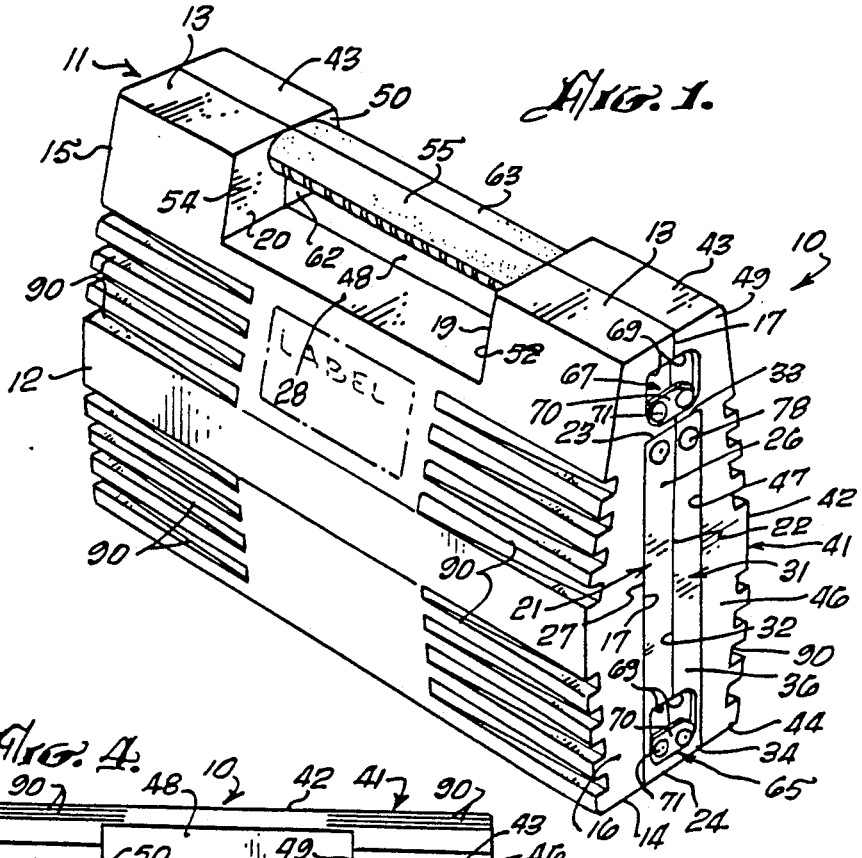
FIG. 1 is a perspective view of the four ply fold-up display and carrying case of the present invention.
Figure 4:
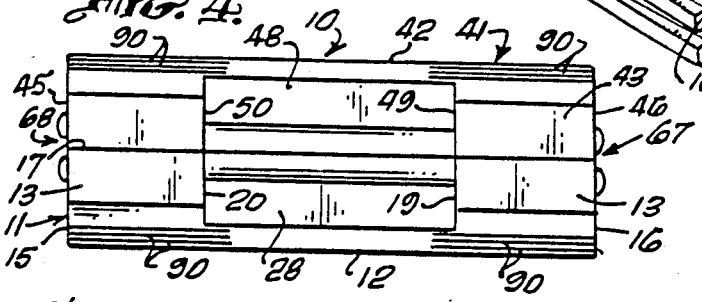
FIG. 4 is a top view thereof.
Figure 2:
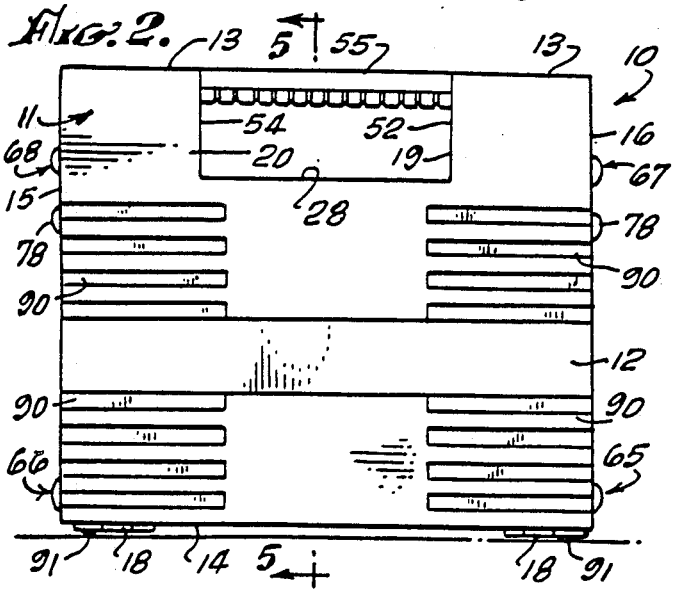
FIG. 2 is a side view thereof.
Figure 3:
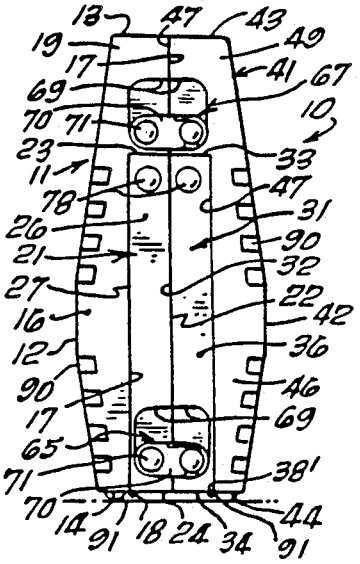
FIG. 3 is an end view thereof.

The four ply fold-up display and carrying case of the present invention is shown in FIG. 1 and indicated by reference character 10. Case 10 has a first ply 11 which is a generally rectangular open compartment. First ply 11 has an outer side 12, a top surface 13, a bottom 14 and two edge sides 15 and 16 (shown best in FIG. 11). Top surface 13 has a center portion 28, and the two edge sides 15 and 16 extend upwardly past the center portion 28. All of the sides have an edge at the open side indicated by reference character 17. A hinge 18 hingedly connects first ply with a second ply 21. Second ply 21 has an inner side 22, a top side 23, a bottom 24, and edge sides 25 and 26. Second ply 21 has four edges 27 at its open side, and bottom 24 is also connected with hinges 18. Third ply 31 has an inner side 32, a top side 33 and a bottom 34. Third ply 31 also has edge sides 35 and 36 and four edges 37 at the open side. A top hinge 38 connects top sides 23 and 33. A bottom hinge 38' is affixed to edge 37 of bottom 34. A fourth ply 41 has an outer side 42, a top surface 43 and a bottom 44. Fourth ply 41 also has edge sides 45 and 46, and the top, bottom and edge sides all have inner edges 47. Top surface has a center portion 48, and the two edge sides 45 and 46 extend upwardly past the center portion 48.

Edge sides 16 and 15 of the first ply extend upwardly at 19 and 20. Similarly, edge sides 46 and 45 extend upwardly at 49 and 50 on fourth ply 41. A small compartment is formed on the first ply by a top wall 51 and an inside wall 52 on edge side 16 and by a top 53 wall and an inside wall 54 along edge side 16. A handle half 55 is connected between insides 52 and 54. The compartments are indicated by reference character 56. Similarly, fourth ply 41 has compartments 57 which are formed with walls 59 and 60 and walls 61 and 62. A second handle half 63 is supported by walls 61 and 62.

There are two pairs of latches. A set of first, or lower, latches indicated generally by reference characters 65 and 66 and a pair of upper latches 67 and 68. Each latch has a pair of recesses 69 into which a latch 70 is operated. Latch 70 is pivotally held in recess 69 by a pivot pin 71 which passes through a pivot pin opening 72 in latch 70 and is held by an opening 73 in recess 69. Latch 70 moves from the unlocked position, shown in phantom view in FIG. 7, to a locked position, as shown in solid lines in FIG. 7, where the latch opening 74 is snapped over latch pin 75 which is held in latch pin opening 76 at the base of recess 69. Latch opening 74 is narrowed as shown, for instance, in FIG. 8 at reference character 77. A ridge 82 on latch 70 facilitates the opening of the latch. A plurality of buttons 78 assist in supporting the case 10 on its side.

Figures 5, 6, 7, 8, 9, 10:
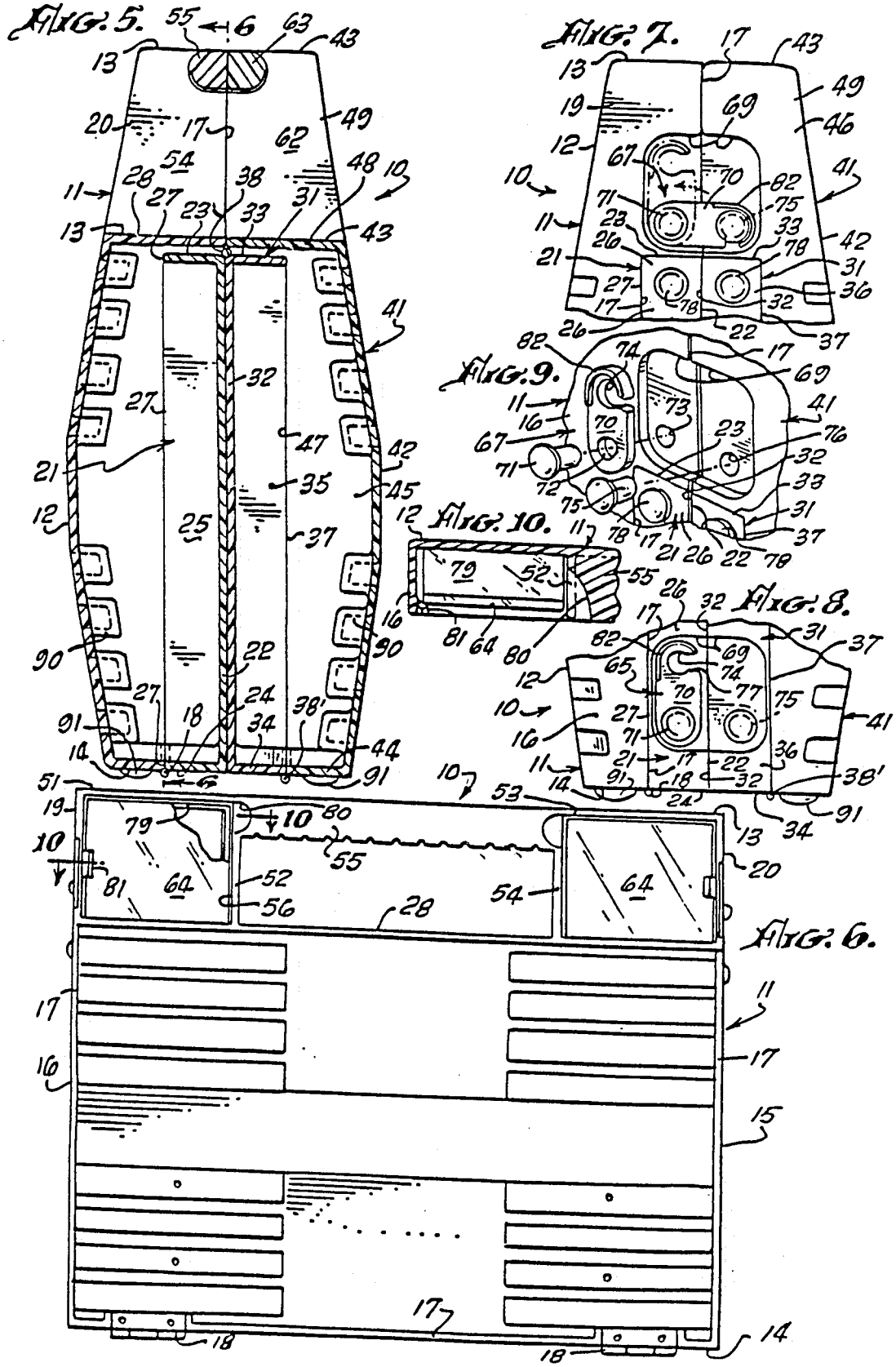
FIG. 5 is a cross-sectional view taken along line 5—5 of FIG. 2.
FIG. 6 is a cross-sectional view taken along line 6—6 of FIG. 5.
FIG. 7 is a view of the top latch of the case of FIG. 1.
FIG. 8 is a view of the bottom latch of the case of FIG. 1.
FIG. 9 is an exploded perspective view of a latch of the case of FIG. 1.
FIG. 10 is a cross-sectional view taken along line 10—10 of FIG. 6.

In a preferred configuration, four removable boxes 79 are held in compartments, 56', 57' and 57 Finger wells 80 facilitate the removal of each of the boxes which are held in by a tab in each compartment 81 as shown best in FIG. 10. Each box, itself, has a lid 64 which is removed with the box and permits the holding of small parts without any danger of spilling.

Decorative grooves 90 have been shown in the two outer sides and, of course, are optional. Support feet 91 may be added to either the sides or bottom of the unit and would typically have antiskid tabs affixed thereto.

The operation of the case is shown best in FIGS. 11 through 16. If all latches are opened, the case may be opened in an accordion manner as shown in FIGS. 11 and 13. It may then be moved to a fully opened configuration as shown in FIG. 15 where the contents are easily displayed on a table or floor. Alternatively, keyway-shaped openings 92 permit the opened case to be supported on a wall. Still further, the case may be partially opened where the first latches have been maintained closed and the upper latches have been opened. This configuration is indicated in FIG 14.

The result is a carrying and display case of exceptional utility. The case has a substantial floor area to which tools or other items may be secured and yet may be easily and compactly closed into the configuration shown in FIG. 1. Four small compartments may hold smaller parts and may have a transparent (e.g. polystyrene) door. The case designed can, of course, be customized for a particular service operation or for any particular set of tools. The case is preferably injection molded and both first and fourth plies are identical and may be made in a single mold. Similarly, the second and third plies are identical and may also be made in a single mold.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A four ply fold-up display and carrying case comprising:

a first ply comprising a generally rectangular, open compartment having an open side, an outer side, a bottom, two edge sides and a top side, each of said bottom, edge and top sides having an edge at the open side, said first ply having hinge means along the edge of the bottom;

a second ply comprising a generally rectangular, open compartment having an open side, an inner side, a bottom, two edge sides and a top side, each of said bottom, edge and top sides having an edge at the open side, said second ply having bottom hinge means along the edge of the bottom which are hingedly attached to the hinge means of said first ply, and said second ply having top hinge means along the intersection of the inner side and the top side;

a third ply comprising a generally rectangular, open compartment having an open side, an inner side, a bottom, two edge sides and a top side, each of said bottom, edge and top sides having an edge at the open side, said third ply having top hinge means along the intersection of the inner side at the top side, which top hinge means are hingedly attached to the top hinge means of the second ply, and said third ply having bottom hinge means along the edge of the bottom;

a fourth ply comprising a generally rectangular, open compartment having an open side, an outer side, a bottom, two edge sides and a top side, each of said bottom, edge and top sides having an edge at the open side, said fourth ply having hinge means along the edge of the bottom, which hinge means are hingedly attached to the bottom hinge means of the third ply;

a first pair of latch means to latch said inner sides of said second and third plies together; and a second pair of latch means to latch the first and fourth plies together over the second and third plies whereby said case may be opened so that all plies are facing upwardly thereby displaying the contents of each ply and said case may be closed into a folded configuration and wherein the top sides of the first and fourth plies extend over the top sides of the second and third plies when the carrying case is in a folded configuration.

2. The four ply fold-up display and carrying case of claim 1 wherein said top sides of said first and fourth plies have a center portion and said edge sides of said first and fourth plies extend upwardly past the center portion of said top sides of said first and four plies, and a carrying handle is supported between the extended portions of said edge sides.

3. The four ply fold-up display and carrying case of claim 2 wherein two small compartments are formed between said carrying handle and said extension of said edge sides.

4. The four ply fold-up display and carrying case of claim 3, wherein said carrying handle is formed in two symmetrical halves, one of said halves being held by said first ply and the other of said halves being held by said fourth ply.

5. The four ply fold-up display and carrying case of claim 1 wherein said first pair of latch means are positioned on said, edge sides of said second and third plies.

6. The four ply fold-up display and carrying case of claim 1 wherein said second pair of latch means are positioned on the edge sides of said first and fourth sides.

7. A four ply fold-up display and carrying case comprising:

a first ply comprising a generally rectangular, open compartment having an open side, an outer side, a bottom, two edge sides and a top side, said top side having a center portion, each of said bottom, edge and top sides having an edge at the open side, said first ply having hinge means along the edge of the bottom, and said top side extending past the edges of said edge sides, and said edge sides extending upwardly past the center portion of said top side;

a second ply comprising a generally rectangular, open compartment having an open side, an inner side, a bottom, two edge sides and a top side, each of said bottom, edge and top sides having an edge at the open side, said second ply having bottom hinge means along the edge of the bottom which are hingedly attached to the hinge means of said first ply, and said second ply having top hinge means along the intersection of the inner side and the top side;

a third ply comprising a generally rectangular, open compartment having an open side, an inner side, a bottom, two edge sides and a top side, each of said bottom, edge and top sides having an edge at the open side, said third ply having top hinge means along the intersection of the inner side at the top side, which top hinge means are hingedly attached to the top hinge means of the second ply, and said third ply having bottom hinge means along the edge of the bottom;

a fourth ply comprising a generally rectangular, open compartment having an open side, an outer side, a bottom, two edge sides and a top side, said top side having a center portion, each of said bottom, edge and top sides having an edge at the open side, said fourth ply having hinge means along the edge of the bottom, which hinge means are hingedly attached to the bottom hinge means of the third ply, and said top side extending past the edges of said edge sides and said edge sides extending upwardly past the center portion of said top side;

a first pair of latch means to latch said inner sides of said second and third plies together;

a second pair of latch means to latch the first and fourth plies together over the second and third plies whereby said case may be opened so that all plies are facing upwardly thereby displaying the contents of each ply and said case may be closed into a folded configuration; and handle means supported between the portions of the top sides of the first and fourth plies which extend upwardly past said center portion of said top sides of said first and fourth plies.

* * * * *